US007905521B2

(12) United States Patent
Liang et al.

(10) Patent No.: US 7,905,521 B2
(45) Date of Patent: Mar. 15, 2011

(54) MULTI-POINT SLIDING DOOR LATCH

(75) Inventors: Luke Liang, South Plainfield, NJ (US); Tong Liang, Guangzhou (CN); David Chen, Guangzhou (CN)

(73) Assignee: Vision Industries Group

( * ) Notice: Subject to any disclaimer, the term of this patent is extended or adjusted under 35 U.S.C. 154(b) by 0 days.

(21) Appl. No.: 11/454,159

(22) Filed: Feb. 15, 2006

(65) Prior Publication Data

US 2007/0200355 A1 Aug. 30, 2007

(51) Int. Cl.
*E05C 9/12* (2006.01)
*E05C 19/12* (2006.01)

(52) U.S. Cl. ..... 292/51; 292/24; 292/39; 292/112; 292/199; 292/DIG. 46

(58) Field of Classification Search ..... 292/24–31, 292/22, 19, 39, 142, 25, 95, 51, 110, 112, 292/280, DIG. 46, 44, 45, 199, DIG. 53, 292/57, 117–120; 70/117–120, 113, 114, 70/95

See application file for complete search history.

(56) References Cited

U.S. PATENT DOCUMENTS

| | | | | | |
|---|---|---|---|---|---|
| 352,617 | A * | 11/1886 | Ives | 292/112 |
| 1,005,295 | A * | 10/1911 | Patterson | 70/154 |
| 1,160,105 | A * | 11/1915 | Bodenstein | 292/27 |
| 1,272,327 | A * | 7/1918 | Bisaillon | 292/122 |
| 3,744,829 | A * | 7/1973 | Germer | 292/22 |
| 4,476,700 | A * | 10/1984 | King | 70/99 |
| 4,958,508 | A * | 9/1990 | Lin | 70/352 |
| 5,391,360 | A * | 2/1995 | Kochte et al. | 422/292 |
| 5,595,409 | A * | 1/1997 | Fier et al. | 292/112 |
| 5,951,068 | A * | 9/1999 | Strong et al. | 292/39 |
| 6,327,879 | B1 * | 12/2001 | Malsom | 70/97 |
| 6,682,109 | B2 * | 1/2004 | Horne et al. | 292/22 |
| 2004/0145189 | A1 * | 7/2004 | Liu | 292/24 |
| 2004/0195841 | A1 * | 10/2004 | Liu et al. | 292/24 |
| 2004/0227349 | A1 * | 11/2004 | Denys | 292/26 |
| 2004/0256860 | A1 * | 12/2004 | Tsai | 292/51 |
| 2006/0076783 | A1 * | 4/2006 | Tsai | 292/24 |

* cited by examiner

*Primary Examiner* — Carlos Lugo
*Assistant Examiner* — Alyson M Merlino
(74) *Attorney, Agent, or Firm* — Thomas A. O'Rourke; Bodner & O'Rourke, LLP

(57) ABSTRACT

A multi-point door latch adapted to fit in the stile of a door. The multi-point door latch includes a pair of hooks that are allowed to rotably pivot around a pair of eccentric cams. The eccentric cams are allowed to rotate inside of apertures located through the hubs of the hooks. The eccentric cams are geometrically centered inside the hubs of the hooks, and are kept in position via pins that are eccentrically orientated through cams. The multi-point door latch also includes an opening for receiving a turning mechanism. In addition, the turning mechanism is connected to a pair of toothed gear wheels that mesh with a toothed bar. The toothed bar is connected to a synchronizing link which simultaneously rotates the hooks to either an engaged or disengaged position. The multi-point door latch also includes stopping members, which prevent the hooks from rotating passed a certain point when the door latch is not engaged.

40 Claims, 16 Drawing Sheets

MULTI-POINT SLIDING DOOR LATCH

FIELD OF THE INVENTION

This invention relates to multi-point door latch and more particularly to a multi-point door latch appropriate for use with sliding doors.

BACKGROUND OF THE INVENTION

Generally, sliding doors may be kept in a latched position when a latch, preferably mounted on the locking side of the stiles of sliding doors, having a hook or other similar element, engages a keeper on the coupled door jamb. Unlike a single-point door latch that provide the engagement between only one hook or similar element and corresponding keeper, the multi-point latch may engage two or more hooks or similar elements and corresponding keepers. In order to increase the safekeeping function of the latch, at least two hooks should face each other. Such arrangement would preclude vertical movement of doors and therefore, disengagement of a latch and a keeper. There are several inventions that embodied an idea of the latch with hooks facing each other. Most of them include simultaneous operation of two hooks positioned in vertically spaced housing. Hooks are usually pivotally mounted in such manner that movement of a thumb turn key generate corresponding pivotal movement of a twin actuator that in turn activates upper and lower actuators interconnected with upper and lower hook correspondingly. Typically, a gang link connects twin actuator with upper and lower actuators. As a result, most of prior inventions utilize a set of relatively complicated and space-demanding mechanisms to convey a pivotal movement from a thumb turn-key to a twin actuator to upper and lower actuators and thus to retract hooks to engage corresponding keepers. The current invention provides a simple and compact packaging for a latch while avoiding complication of contemporary latches and at the same time does not compromise the security of multi-point door latches.

SUMMARY OF THE INVENTION

The invention may fit in an opening of a lock face of a stile of a sliding door and may be arranged for co-action with a keeper positioned on associated jamb as well as for co-action with a thumb turn-key through generally rectangular drives slots of the hubs sized generally to receive tail member of a thumb turn-key.

According to a further feature of the invention, a thumb turn-key may be mounted on the inside surface of the sliding door. A latch may have a housing assembly, upper and lower hooks, and central actuator operative in response to turning movement of tail member to move upper and lower hooks from latched or retracted position to unlatched position; upper and lower cams positioned within upper and lower hooks correspondingly, a link that simultaneously connects central actuator with upper and lower hooks upper and lower cams.

According to a further feature of the invention, the housing may have two rectangular plates forming two walls that may define a vertically elongated hollow interior. These walls may be held together by rivets. The housing may be sized to fit within the opening in the lock face of a stile of a sliding door.

According to a further feature of the invention, actuator assembly may include an actuator and a synchronizing link. The actuator may be in form of a rack-and-pinion, or an arrangement of a toothed bar that meshes with gear wheel or wheels. One embodiment may include a toothed bar that meshes with two segments of the gear wheel. Each segment may be in form of pivot arm and include a toothed portion and a hub portion. Hub portion of a gear wheel may define trunnions for journaling in suitable apertures in the walls of the housing so as to mount the hub portions of pivot arms for rotation within the housing around pivot axis. Hub portions of the segments may include a rectangular drive slot sized to drivingly receive tail member of the thumb turn-key, and may extend from wall to wall of the housing. The tooth portion of each segment may have several teeth that meshes with the toothed bar in such manner that rotation of the tail member would cause rotation of either segment around its axis, the teeth of segment gear may engaged the toothed bar to move, engaging the second geared segment. Thus, one embodiment may be configured in such way that the rotation of the tail member causes synchronized rotation of geared segments. The toothed bar may be firmly connected with the synchronizing link in such manner that turning movement of the tail member causes the synchronizing link to move in vertical direction along walls of the housing. The synchronizing link may engage both upper and lower actuator as well as upper and lower hooks.

According to a further feature of the invention, upper and lower hooks may have a hook portion, an aperture, and a hub portion. An aperture may be configured in the hub portion of the hook. Upper hook may have a pivotal eccentric cam sized to fit the aperture portion of the hook. The pivotal eccentric cam may be configured to freely rotate within the upper hook's aperture independently from the hook. The hook may rotate around the eccentric cam. The eccentric cam may have a pivotal pin that extends outwardly from both sides of a cam. The ends of both sides of the pin may be rotatably positioned within corresponding aligned apertures made in the both walls of the latch. The geometric center of the pivotal pin of the eccentric cam may be displaced from the geometric center of the eccentric cam. The cam may rotate around a pivotal pin's axis. Therefore, because of such configuration of the hook, eccentric cam and the pin, the revolving movement of the cam within the aperture of the hook may cause the latter to move back and forth in the direction perpendicular to the axis of rotation of the cam if the hook does not revolve along with the cam.

According to a further feature of the invention, the hub portion of an upper hook may have protrusions. An upper eccentric cam may have grooves and protrusions. The hub portion of the upper hook and the upper cam may be interconnected through such grooves and protrusions. It will be seen that turning movement of the cam may move the hub portion, and therefore, the upper hook around the pivotal pin. The geometric center of the hub portion of the upper hook may coincide with geometric center of the eccentric cam. Thus, if the hook revolves around the eccentric cam, such movement may cause the upper hook to travel forwardly and rearwardly within the hollow of the housing to unlatched and latched positions. Similarly, if the eccentric cam engages the hook through the hub portion and the eccentric cam turns around the pivotal pin along with the hook, such turning movement may cause the upper hook to revolve forwardly and rearwardly around its geometrical center within the hollow of the housing in the direction perpendicular to the revolving movement of the hook.

According to a further feature of the invention, the hook portion, the aperture portion and the hub portion of the lower hook may be identical to the upper hook except for their orientation within the housing as well as number and positioning of protrusions. When the hooks are in their latched or retracted position, the hook portion of the upper hook may point downwardly and the hook portion of the lower hook may point upwardly.

According to a further feature of the invention, a synchronizing link may be in a form of generally elongated rectangular plate that may move vertically along an inner side of one plate of the housing. A synchronizing link may extend from a lower hook to an upper hook in parallel relation to the inner side of the front wall of the latch housing. The synchronizing link may have a protrusion on its lower portion that may activate a lower hook and the other protrusion on its upper portion that may activate an upper hook through a rocker arm and a pushrod. Also, the synchronizing link may have cuts of such shape that surfaces formed by those cuts may engage both upper and lower eccentric cams at the certain point relative to the engagement of upper and lower hooks upon the movement of the synchronizing link.

According to a further feature of the invention, the turning movement of the thumb turn-key may engage an actuator. The rotation of geared wheels may move a geared bar. Because a synchronized link is firmly connected to a geared bar, the rotation of the thumb turn-key may cause the back-and-forth movement of a synchronizing link in the vertical direction along walls of the housing of a latch.

According to a further feature of the invention, the synchronizing link may engage both upper and lower hooks; it may engage the upper hook through a rocker arm, a pushrod and a protrusion made at the tip of the upper portion of the synchronizing link, and the lower hook through a protrusion made on the inner surface of the lower portion of the synchronizing link. It will be shown that when a turn-key is rotated from unlatched toward latched position a synchronizing link may move upwardly along walls of a housing of a latch. A protrusion made on the tip of the upper portion of the synchronizing link may engage the suspended end of the rocker arm pushing it upward. The opposite end of a rocker arm is pivotally connected to the pushrod which in turn pivotally connected to the hub portion of the upper hook. Because an upper hook is pivotally positioned on the pivotal eccentric cam and may rotate around it, the vertical movement of a pushrod causes the hub portion of an upper hook to rotate around an eccentric cam. Such vertical movement of the synchronizing link may be limited by the travel limiter that may be passed through the elongated aperture made in the upper portion of the synchronizing link and extends through the upper portion of the link in parallel relation to the link. The upper hook may revolve from unlatched vertical position to horizontal latched position in perpendicular relation to the synchronizing link. At the point an upper hook revolves for approximately 90 degrees from unlatched position, the further movement of the synchronized link and therefore the revolving movement of the upper hook are stopped when the travel limiter is pressed against the lower edge of the elongated aperture made in the upper portion of the synchronizing link. A travel limiter, an elongated aperture and their positioning in the lower portion of the synchronizing link may be identical to these of an upper one.

According to a further feature of the invention, an eccentric pivot cam may have a flange around one side of the cam. The flange may secure the positioning of the cam within the aperture portion of the hook from one side. The washer that may be frictionally insertably positioned on the cam upon the opposite side may secure the positioning of the cam within the aperture portion of the hook from the other side. The washer of the lower cam may have an extension that may co-act with the protrusion present on the rear edge of the front wall of the plate to prevent the further up-right rotation of the lower hook. The up-right position of both hooks may be necessary to lock both hooks on the latched position. Such locked position of hook may be achieved by moving both hooks in the direction perpendicular to axis of their rotation. The locked position of both hooks may be provided by rotation of the upper and lower cams relative to the upper and lower hooks. The off-center positioning of the center of rotation of such cams would cause both hooks to move toward the back edges of the plates maintaining their up-right position relative to the plates until protrusion made on the rear edges of both plates co-act with hub portions of both hooks and prevent the rotation of such hooks backward to unlatched position. The locked position of both hooks would add extra-security to the latch.

DETAILED DESCRIPTION OF THE PREFERRED EMBODIMENT

Figure 1:
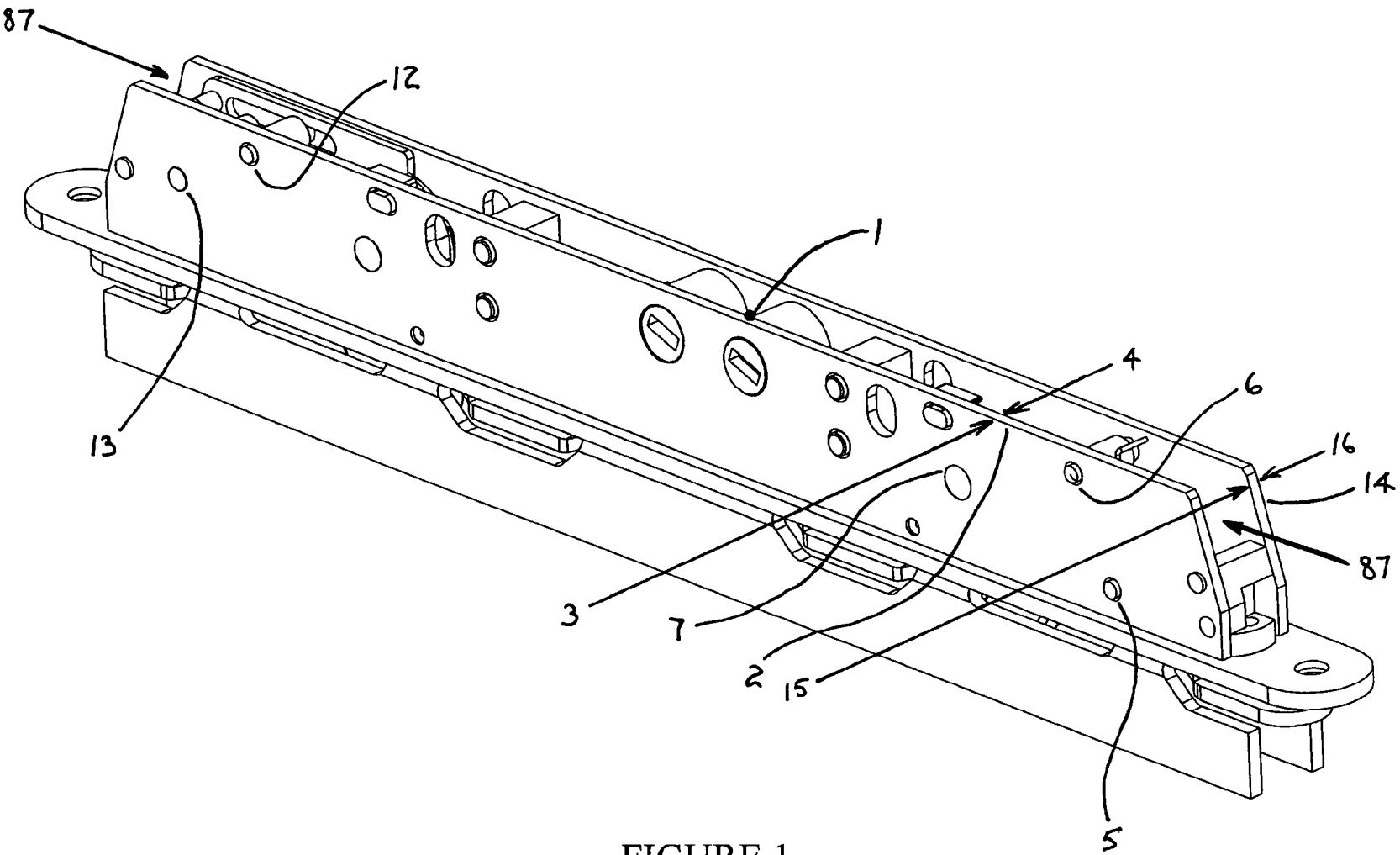
FIG. 1 is a perspective view of the multi-point door latch engaged with a keeper.
Figure 2:
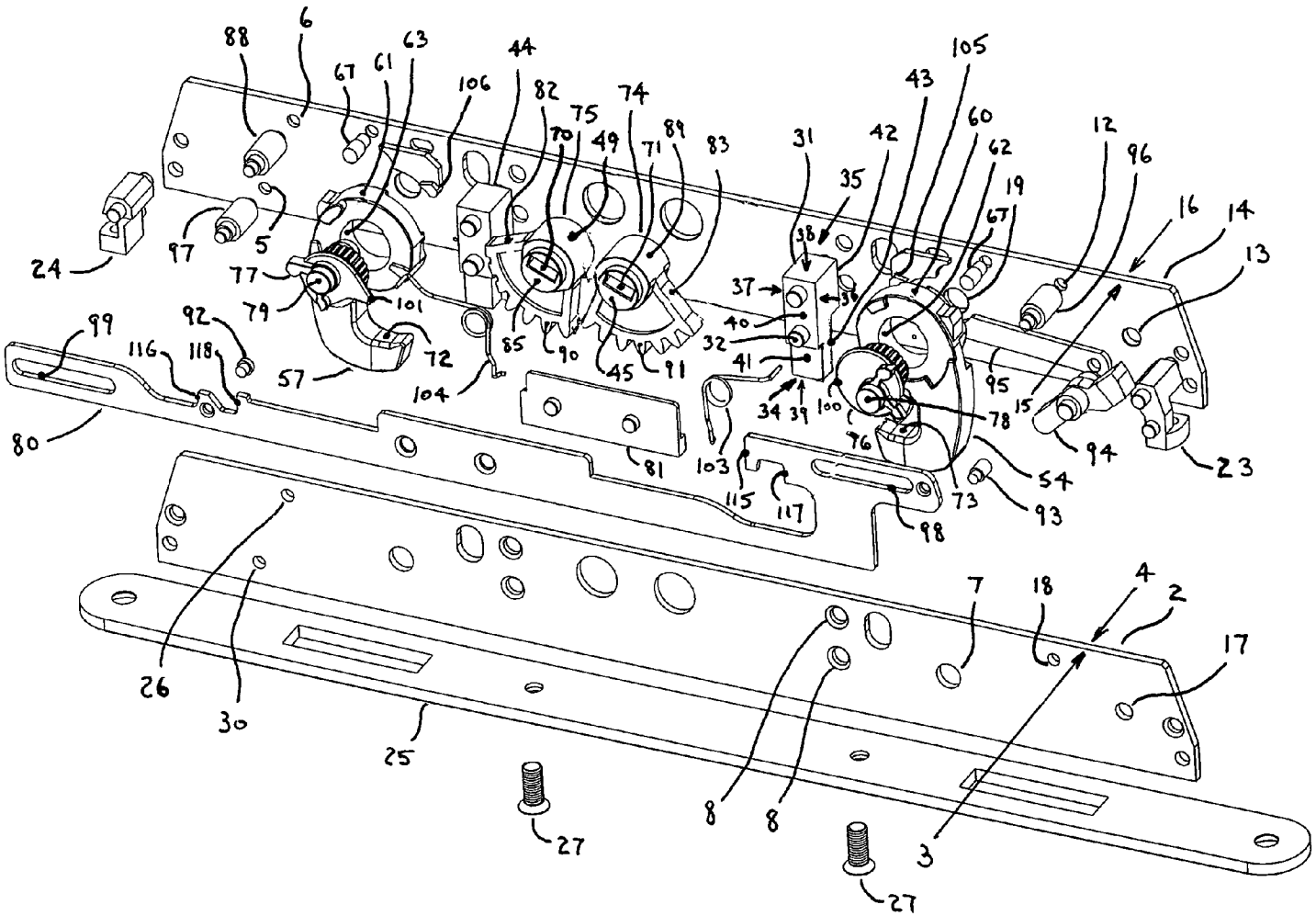
FIG. 2 is an exploded view of the multi-point door latch.

A latch may have a housing assembly 1 which in turn may have an upper hook 54, a lower hook 57, central actuator 75 operative in response to turning movement of tail member of the thumb turn-key to move upper and lower hooks 54 and 57 from the unlocked or retracted position to the locked position; an upper eccentric cam 76 and a lower eccentric cam 77 positioned within upper and lower hooks 54 and 57 correspondingly, and a synchronizing link 80 that simultaneously connects central actuator 75 with upper and lower hooks 54 and 57 and upper and lower eccentric cams 76 and 77.

The housing may have two generally rectangular plates 2 and 14, and cover plate 25. The rear wall 4 of the plate 2 and the front wall 15 of the plate 14 may define a vertically elongated hollow interior 87. The housing assembly may be sized to fit the space flanked by the rear wall 4 of the plate 2 and the front wall 15 of the plate 14 or otherwise provided by the hollow interior 87. The plates 2 and 14 may be aligned in parallel relations by the upper elongated separator 31, the lower elongated separator 44, the upper traverse separator 23 and by lower traverse separator 24. The housing may be sized to fit within the opening in the lock face of a stile of a sliding door.

The upper elongated separator 31 may have generally rectangular shape and may be positioned in the perpendicular relation to both plates 2 and 14. The upper elongated separator may be generally defined by two elongated sides 34 and 35 which are positioned in parallel relations to each other, by surfaces 36 and 37 and by surfaces 38 and 39. The present embodiment of the side 34 may have two sections. Sections 40 and 41 may be separated by a step formed by surfaces that form a 90 degrees angle. It would be shown later that such configuration of the side 34 may be necessary to provide the space between the rear wall 4 of the plate 2 and the upper elongated separator 31 for free movement of the synchronizing link between such rear wall 4 and the section 41 of the side 34 of the upper elongated separator 31. Section 40 of the side 34 may be adjacent and run parallel to the rear wall 4 of the plate 2. Section 40 may have protrusions 32 generally cylindrical in shape extending outwardly and sized to insertably receive apertures 8 of the plate 2 of the assembly 1. The length of the protrusions 32 may be such that when the protrusions 32 are inserted into corresponding apertures 8 of the plate 2, it would be possible to make heads on the portion protruding from wall 3 of the plate 2 to secure the upper elongated separator 31 to the plate 2. The side 35 of the separator 31 may be parallel to the side 34 and may extend through the entire width of the plate 2 and may have one section or have two sections. The present embodiment of the side 35 of the upper separator 31 may have two sections. The configuration of these sections 42 and 43 may be identical to the sections 40 and 41 of the side 34 of the separator 31. The section 42 may have two protrusions 32 identical to protrusions on the section 40 of the side 34 and where protrusions 32 are inserted into corresponding apertures on the plate 14 aligned with apertures made in the plate 2 and then the heads may be formed on their protruding ends. The lower separator 44 may be identical to the upper separator 31. Separator 31 may have a tapped hole on Face 39, and separator 44 may have a similarly tapped hole to accept screws 27 for attachment of cover plate 25. Although positioning of either separator relative to plates 2 and 14 may vary, in the present embodiment both separators are positioned symmetrically relative the geometrical center of the plates 2 and 14 and in such way to minimize the interference with other parts of the housing assembly.

There may be additional separators positioned on the periphery of plates 2 and 14 to help to maintain equal distance between the plates. The present embodiment may have three separators 96, 97 and 88 generally in shape of a cylinder. Such cylinder may have their height generally equal to the desired width between the plates 2 and 14 and the distance between section 40 and 42 of the elongated separator to keep the same distance between the plates. Maintaining equal distance between plates through the length of the plates may allow jam-free interaction of the different elements of the latch. Separators 96, 97, and 88 may have extensions from each end and may be sized to insertably receive paired aligned apertures 12, 18, 5, 30, 6, and 29, and the length of such extensions may be sufficient to allow forming heads on the portion protruding from outer walls of the plates. It will be shown later that these traverse separators may also function as pivotal axis or travel limiter for the synchronizing link. The quantity and the positioning of traverse separators relative to plates 2 and 14 may vary.

A housing assembly 1 may include central actuators 74 and 75. Each actuator may be in the form of a toothed pivot arm and a hub portion, where, in the present embodiment, central actuator 74 is shown with toothed pivot arm 83 and hub portion 89, and central actuator 75 is shown with toothed pivot arm 82 and hub portion 49. The purpose of the central actuators 74 and 75 is to work in conjunction with the synchronizing link 80, forming a rack and pinion arrangement, to convert the revolving movement initiated by the turn-key into the vertical movement of the synchronizing link 80 in order to drive the hooks 54 and 57 and engage the keeper. The present embodiment may have a toothed bar 81 that meshes with the toothed pivot arms 82 and 83 of central actuators 75 and 74. The hub portion 89 of central actuator 74 may define trunnion 45 for journaling in suitable apertures in the plates 2 and 14 of the latch so as to mount the hub portion for rotation within the housing around a pivot axis. Hub portion 49 of central actuator 75 similarly defines trunnion 85 for journaling in suitable apertures in plates 2 and 14. Trunnions 85 and 45 in hub portions 49 and 89 of central actuators 75 and 74 may include rectangular drive slots 70 and 71 sized to drivingly receive the tail member of the thumb turn-key, and may extend from the front wall 3 of the plate 2 to rear wall 16 of the plate 14 of the housing. The toothed pivot arms 82 and 83 of each actuator may have several teeth 90 and 91 that mesh with the toothed bar 81 in such manner that rotation of the tail member would cause rotation of either actuator around its axis, so that the teeth 90 and 91 engage the toothed bar 81 to move, the bar and synchronizing link 80. The toothed bar 81 may be firmly connected with the synchronizing link 80 in such manner that turning movement of the tail member causes the synchronizing link 80 to move in vertical direction along the inner face 4 of plate 2 of the latch. The synchronizing link 80 may engage both upper and lower hooks 54 and 57 as well as upper and lower eccentric cams 76 and 77. It will be shown that sequenced engagement of hooks 54, 57 and eccentric cams 76, 77, encompassing both slaved and relative hook/cam motion, is necessary to provide secure locking function of the latch.

Figure 3:
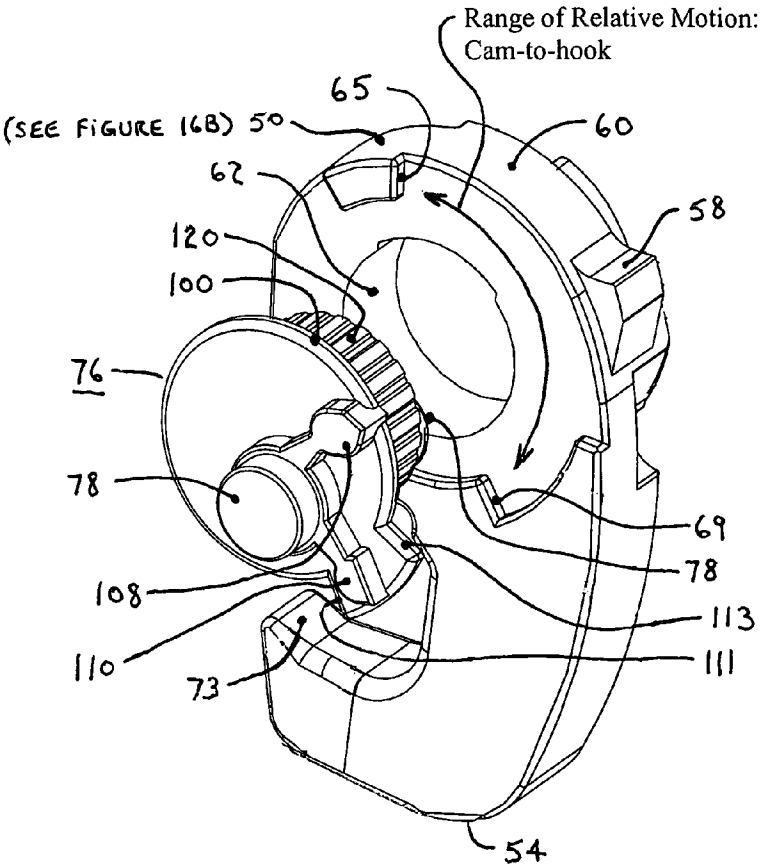
FIG. 3 is a magnified view of the hooks of the multi-point door latch.
Figure 3A:
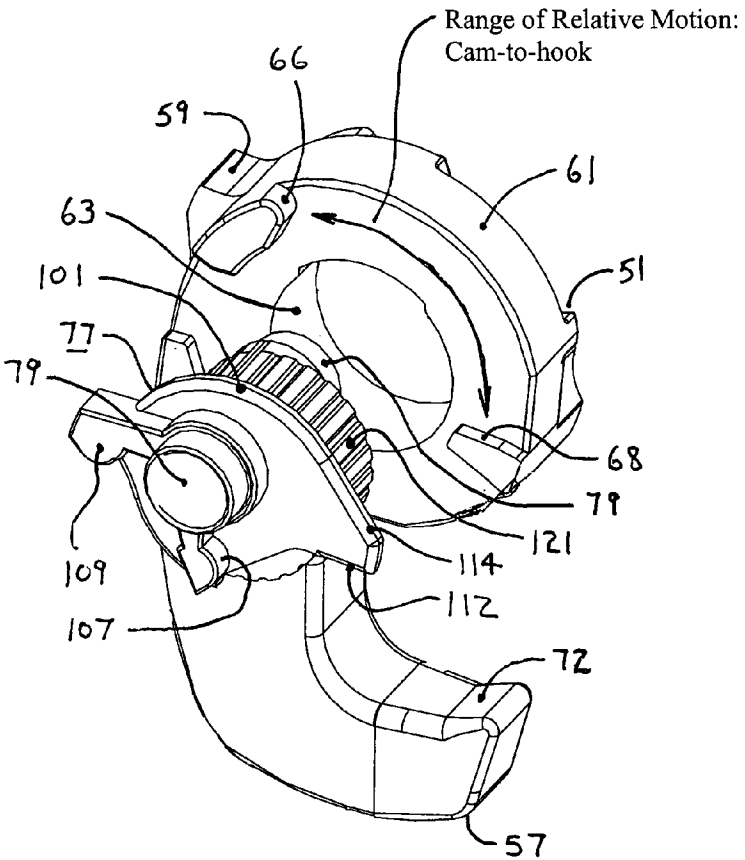
FIG. 3*a* is a magnified view of the eccentric cams of the multi-point door latch.
Figure 5:
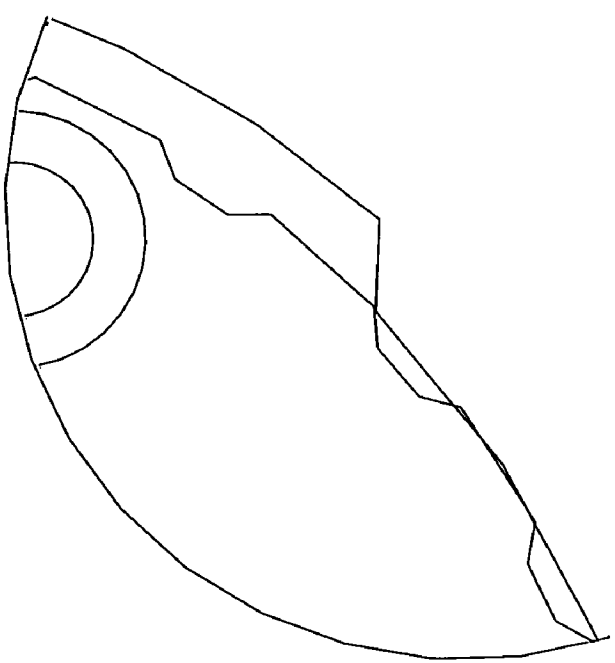
FIG. 5 is side view of the eccentric cam of the multi-point door latch.
Figure 4:
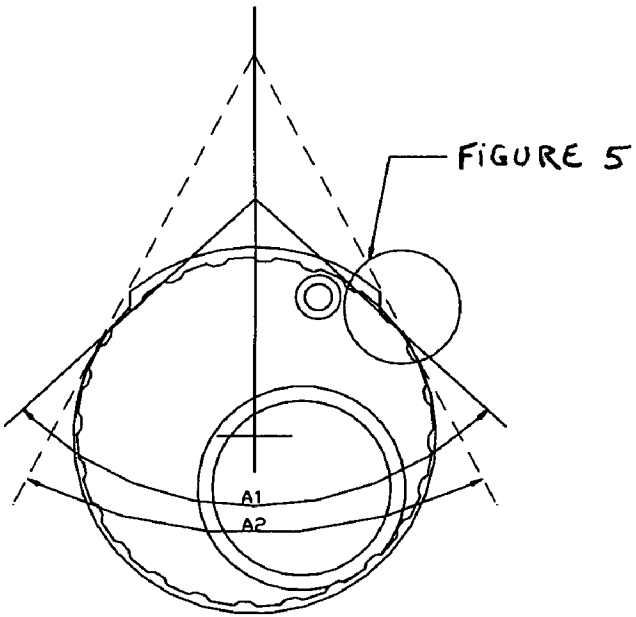
FIG. 4 is an orthographic view of the eccentric cam of the multi-point door latch.
Figure 6A:
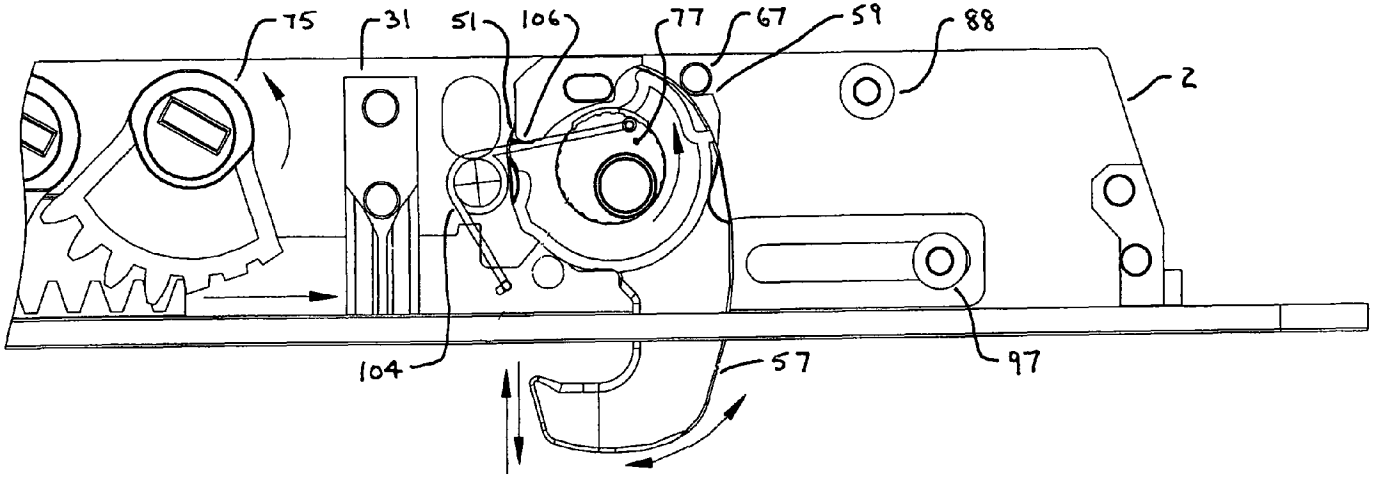
FIG. 6 is side view of the multi-point door latch, with the spring biasing one of the eccentric cams in a locked position.
Figure 6:
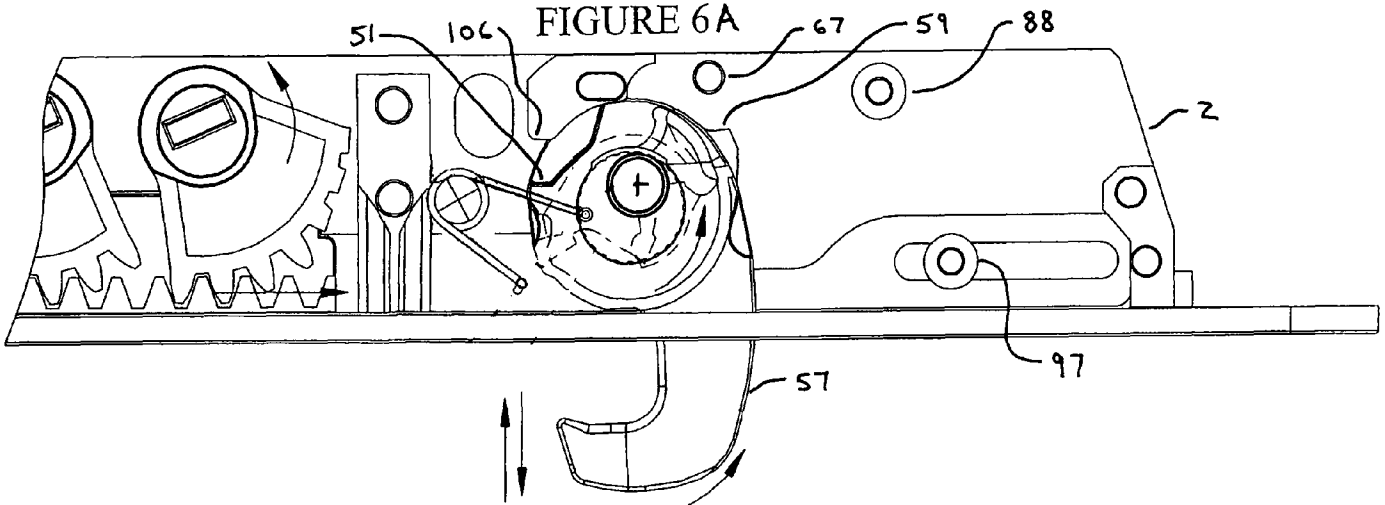
Figure 7A:
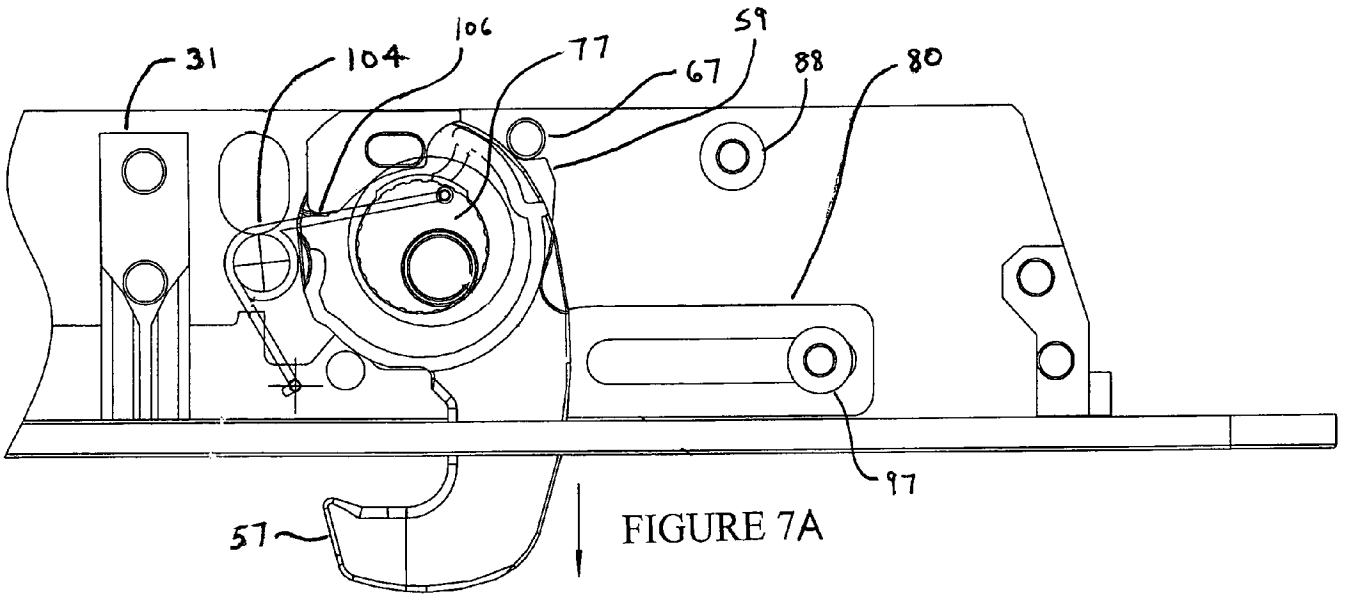
FIG. 7 is side view of the multi-point door latch, with the spring biasing one of the eccentric cams in a unlocked position.
Figure 7:
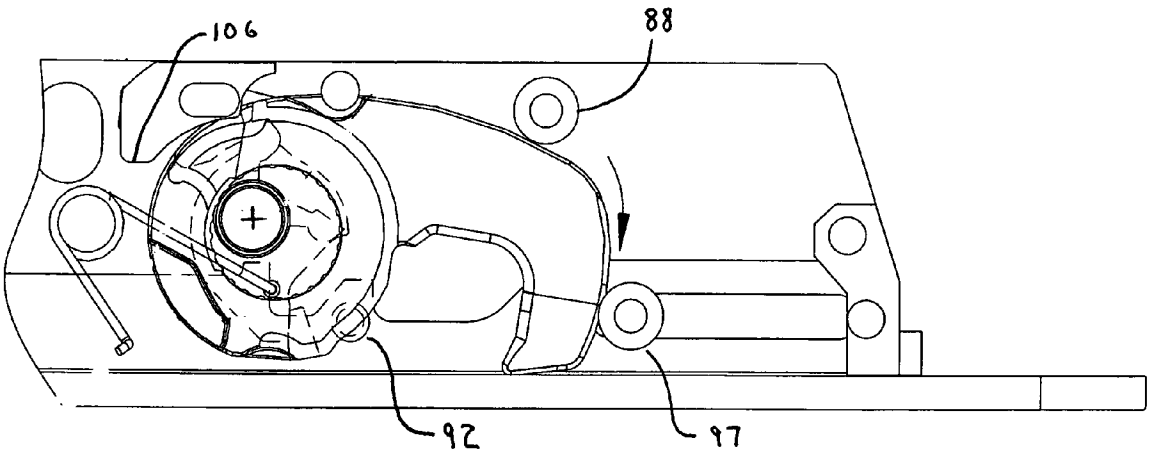
Figure 8:
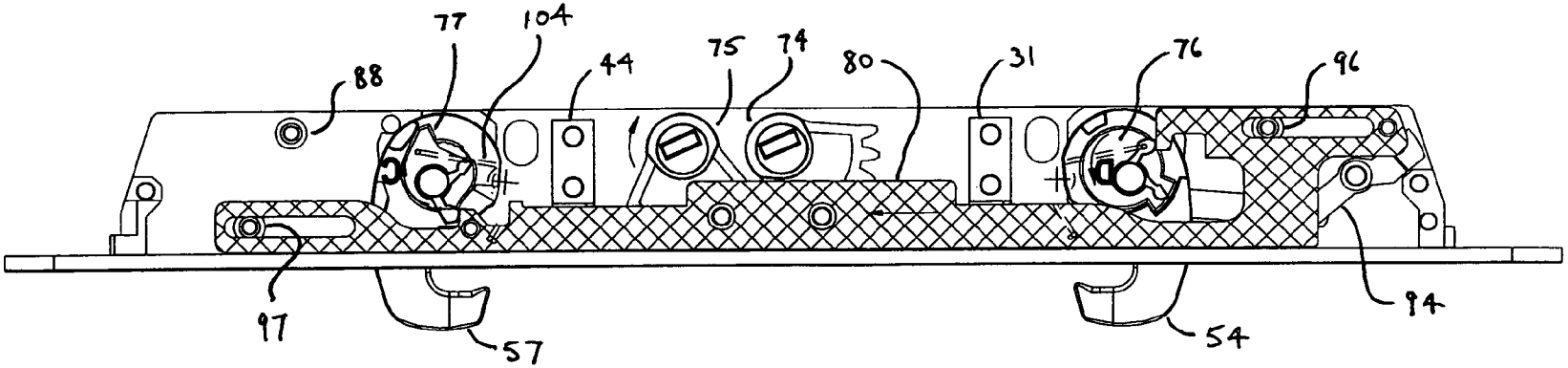
FIG. 8 is a front side view of the multi-point door latch, with the hooks in a closed position.
Figure 9:
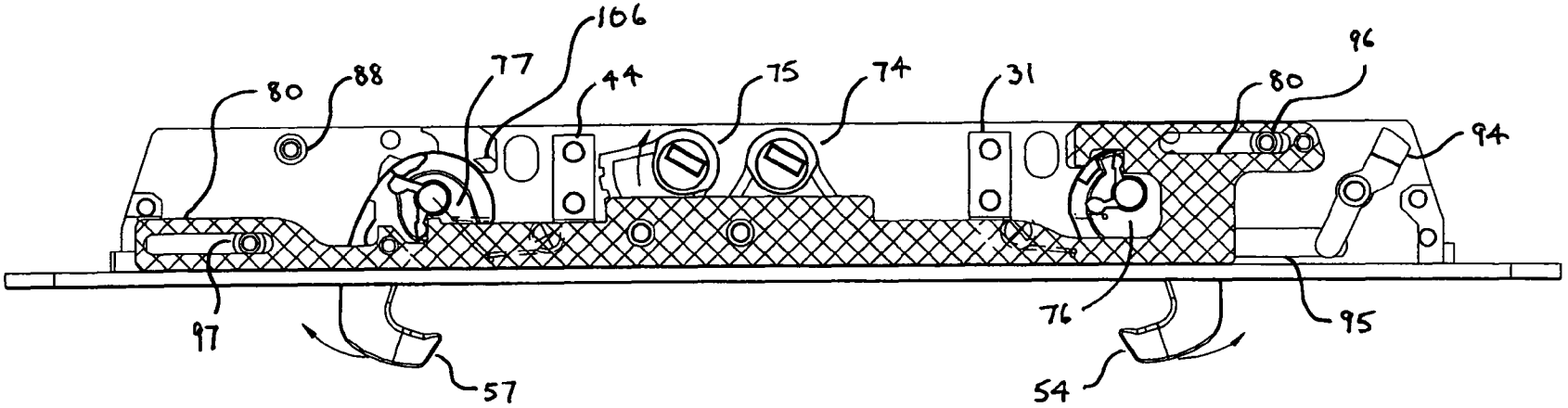
FIG. 9 is a front side view of the multi-point door latch, with the hooks pivoting toward an opened position.
Figure 10:
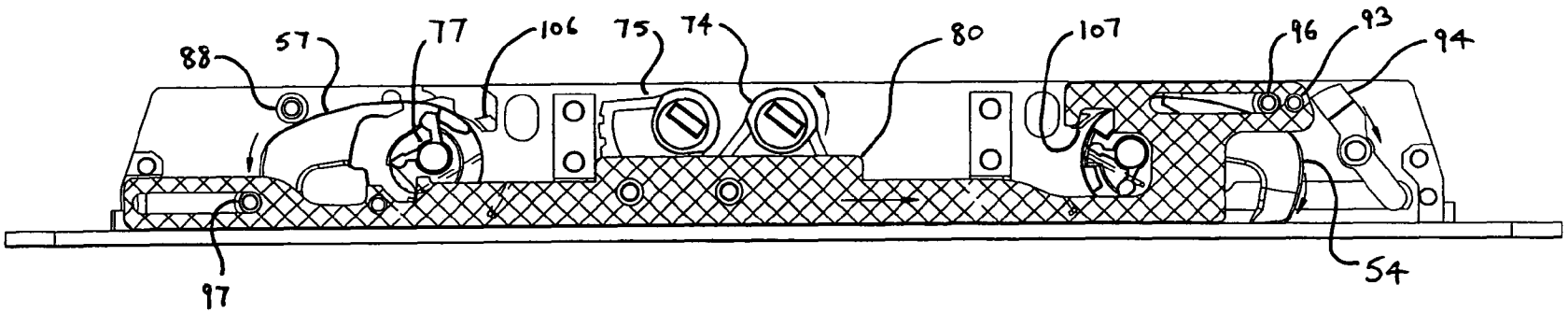
FIG. 10 is a front side view of the multi-point door latch, with the hooks in an opened position.
Figure 11:
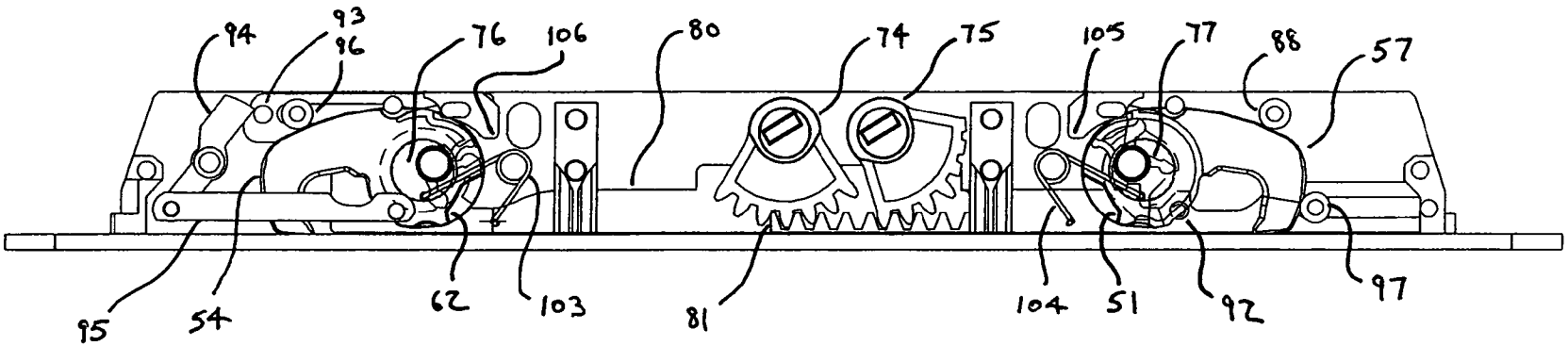
FIG. 11 is a reverse side view of the multi-point door latch, with the hooks in an opened position.
Figure 12:
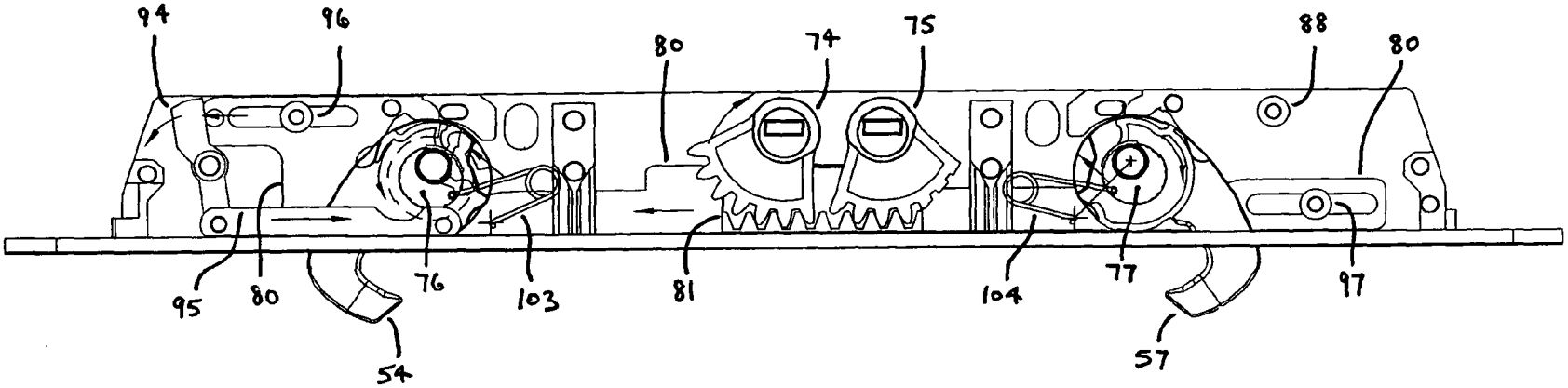
FIG. 12 is a reverse side view of the multi-point door latch, with the hooks pivoting toward a closed position.
Figure 13:
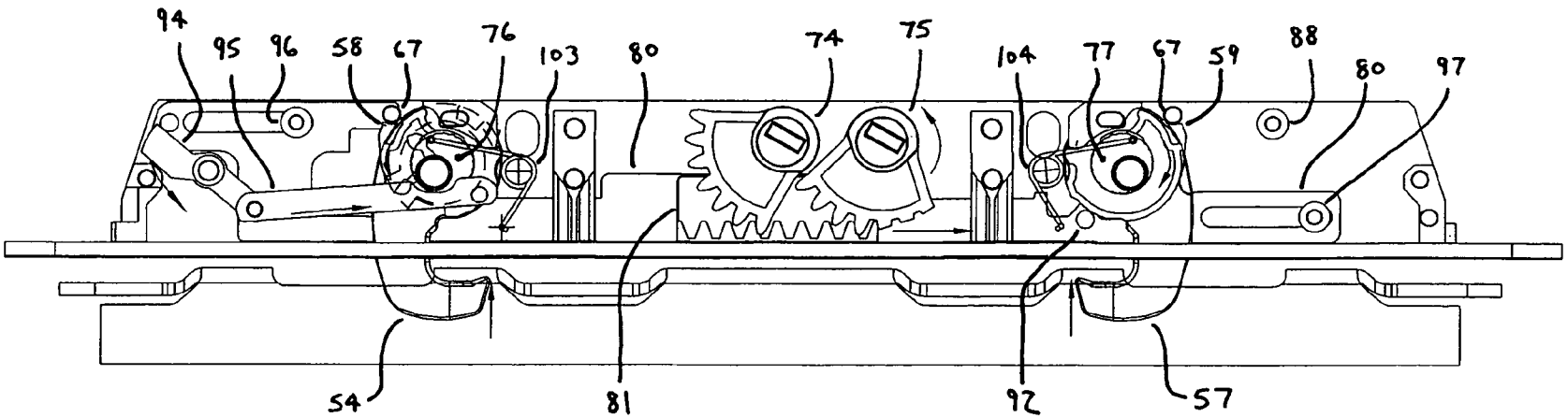
FIG. 13 is a reverse side view of the multi-point door latch, with the hooks in a closed position.
Figure 14:
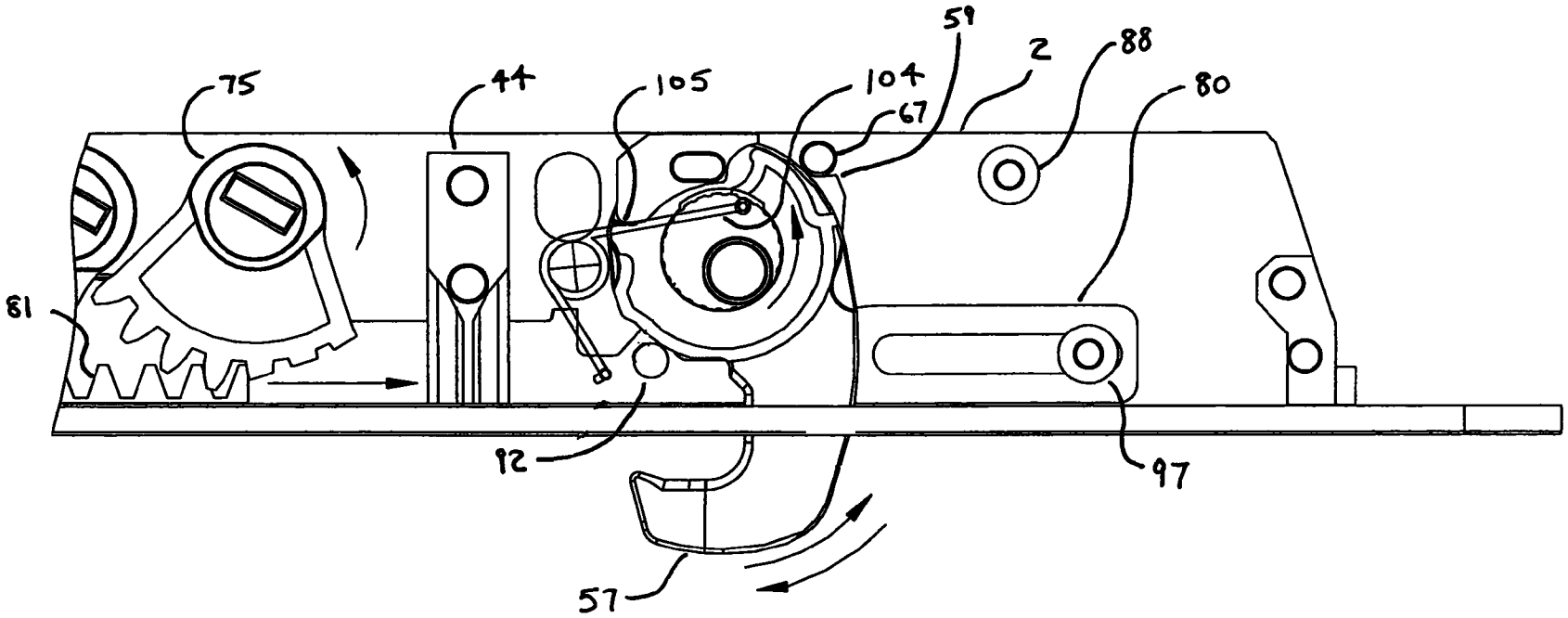
FIG. 14 is a side view of the multi-point door latch, with the hook engaged with a stopping member.
Figure 15:
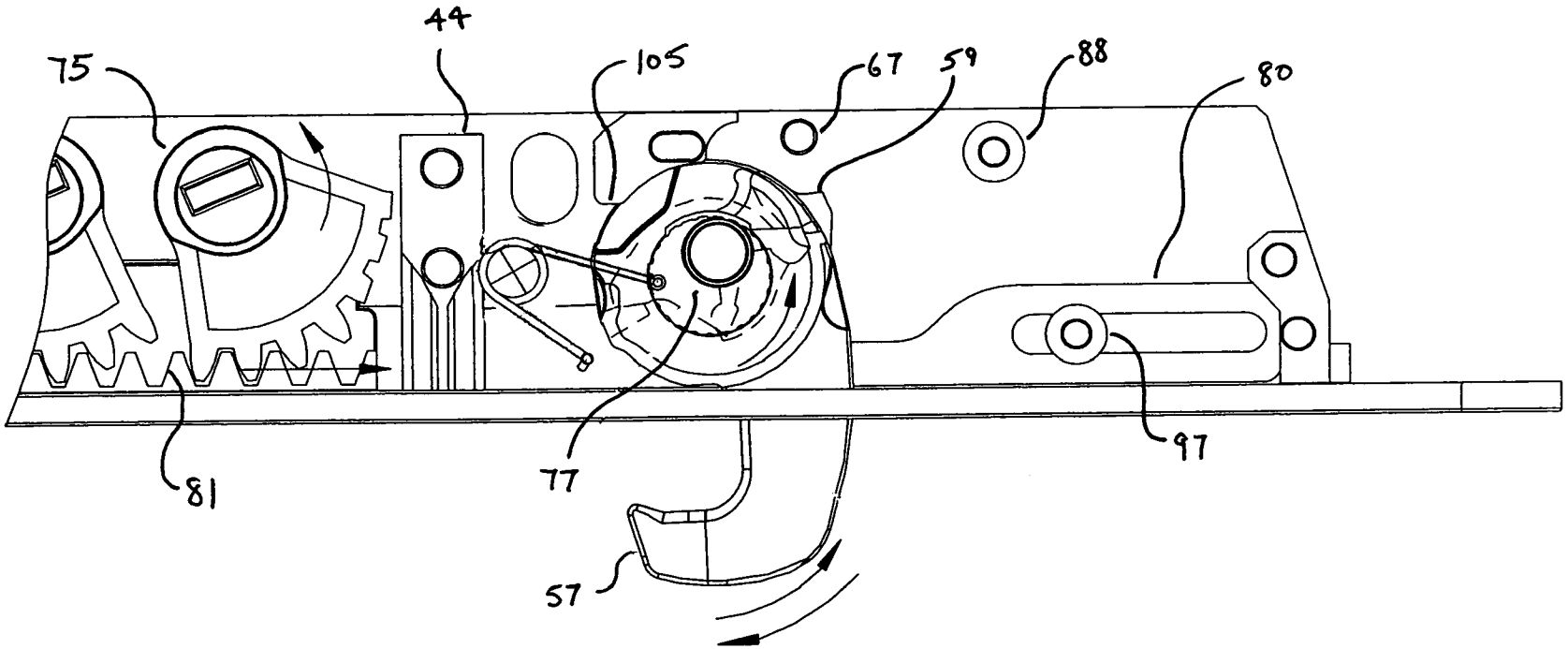
FIG. 15 is a side view of the multi-point door latch, with the hook disengaged from the stopping member
Figure 16:
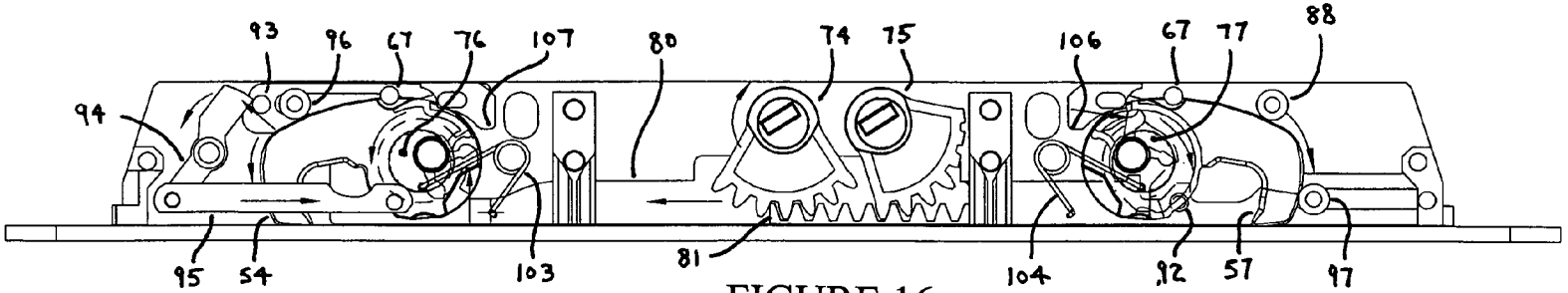
FIGS. 16, 16A, and 16B are views of FIGS. 11,12, and 13 being shown on a single sheet to illustrate the sequence of latch movements in going from the unlocked position to the locked position.
Figure 16A:
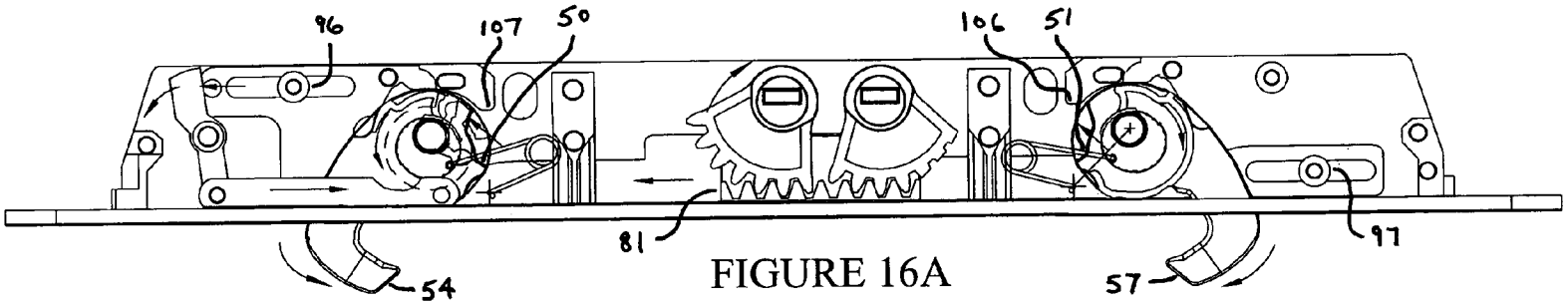
Figure 16B:
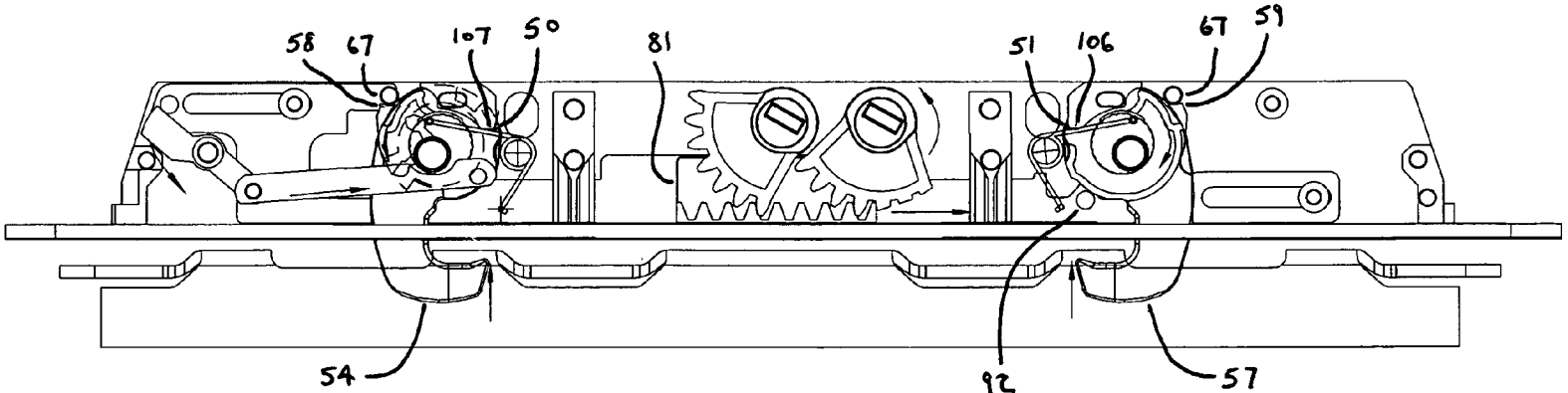
Figure 17:
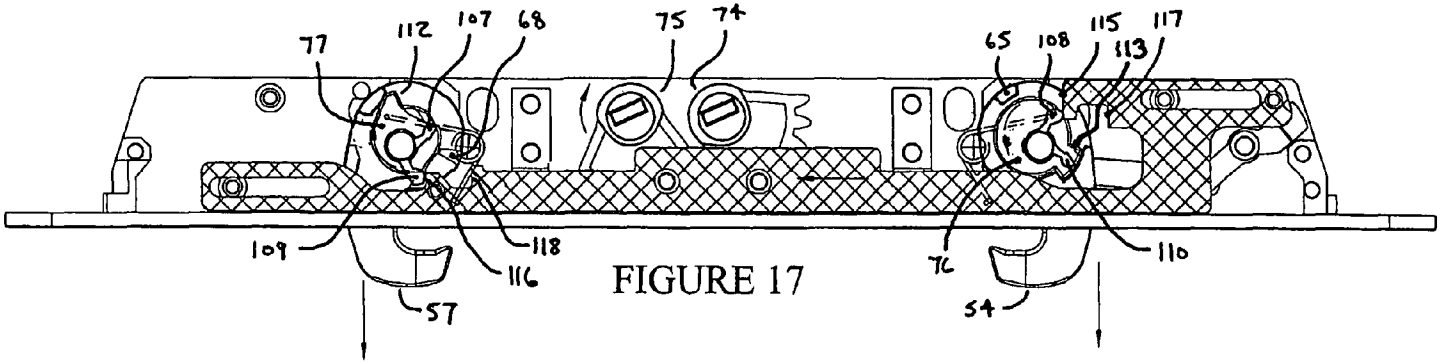
FIGS. 17, 17A, and 17B are the views of FIGS. 8, 9, and 10 being shown on a single sheet to illustrate the sequence of latch movements in going from the locked position to the unlocked position.
Figure 17A:
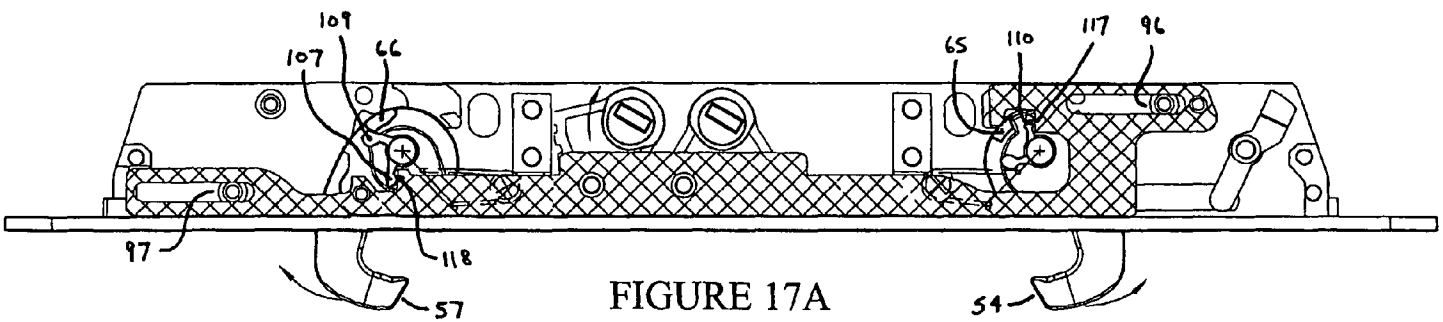

Upper and lower hooks 54 and 57 may be sized to fit between face 4 of plate 2 and face 15 of plate 14, and be positioned to engage keepers on the associated jamb. It will be understood that turning movement of the thumb turn-key revolves the central actuators 74 and 75 which moves vertically the toothed bar 81 along with attached synchronized link 80 that engages hooks 54 and 57 in turning movement from the unlatched to latched position to engage keepers on the associated jamb. Also, it will be understood that after the hooks 54 and 57 are rotated from the unlatched to latched position, the further rotation of them is prevented by stops in order to secure the hooks in the upright position. The hooks may ultimately move into the locked position by traveling in a direction perpendicular to the axis of their prior turning movement, when they co-act with eccentric cams. An upper hook 54 may have a hook portion 73, an aperture 62, and a hub portion 60 (see FIG. 3). An aperture 62 may be configured in the hub portion 60 of the hook 54. Upper hook 54 may have a pivotal eccentric cam 76 sized to fit the aperture 62 of the hook 54. The upper pivotal eccentric cam 76 may be configured to freely rotate within the upper hook's aperture independently from the hook 54. The hook 54 may rotate around the eccentric cam. The eccentric cam 76 may have a pivotal pin 78 that extends outwardly from both sides of a cam 76. The ends of both sides of the pin 78 may be rotatably positioned within corresponding aligned apertures 7 and 19 made in the both plates 2 and 14 of the latch. The geometric center of the pivotal pin 78 of the eccentric cam may be displaced from the geometric center of the eccentric cam 76. The eccentric cam 76 may rotate around a pivotal pin 78 axis. It will be understood that, if the hook 54 does not revolve along with the cam or revolves at a different speed, then because of the configuration of the hook 54, eccentric cam 76 and the pin 78, the revolving movement of the eccentric cam 76 within the apertures 7 and 19 may cause the hook 54 to move in the direction perpendicular to the axis of rotation of the eccentric cam 76. The hub portion 60 of the upper hook 54 may have protrusions 65 and 69 designed for co-action with the eccentric cam 76. The size and positioning of such protrusions may define at which stages of the revolving movement of the hook 54 it may co-act with such eccentric cam 76. An upper eccentric cam 76 may have a flange 100 on one side of the cam such that the hook 54 can mount to the cylindrical shape of the cam and be pressed flush against the cam's flange. The flange 100 of upper eccentric cam 76 may have a protrusion or extension which has two edges, 111 and 113. The upper hook 54 and the upper cam 76 may thus be interconnected through edges 111 and 113 of the cam 76 flange extension, and protrusions 65 and 69 on hook 54. It will be understood that turning movement of the cam 76 may engage the protrusions on the hub portion 60, and therefore, the upper hook 54 will rotate around the pivotal pin. The geometric center of the hub portion 60 of the upper hook 54 may coincide with geometric center of the eccentric cam 76. Thus, if the eccentric cam 76 revolves around its off-geometric center axis and the upper hook 54 remains motionless, such interaction may cause the upper hook 54 to translate in a direction perpendicular to its rotation axis, and may be into or out of the hollow 87 of the housing (sees FIGS. 6 and 6A). However, when the speed and direction of rotation of the hook 54 and the cam 76 coincide, such as when the hook is driving the cam (FIGS. 16 and 16A) or the cam is driving the hook (FIGS. 17 and 17A), the motion of the hook 54 is rotational and is about pin 78 of the eccentric cam 76.

The aperture 63, hub 61, and protrusions 66 and 68 of the lower hook 57, as well as the flange 101 with protrusion or flange extension having edges 112 and 114 on the lower cam 77 may be configured similarly to those of the upper hook 54 and cam 76. When the hooks are in their unlocked or retracted position, the hook portion 73 of the upper hook 54 and the hook portion 72 of the lower hook 57 shall point out through cover plate 25, and both hooks may be positioned such that they rotate outward to face each other, or alternatively have their positions reversed such that the hooks rotate outward and face away from each other.

Figure 17B:
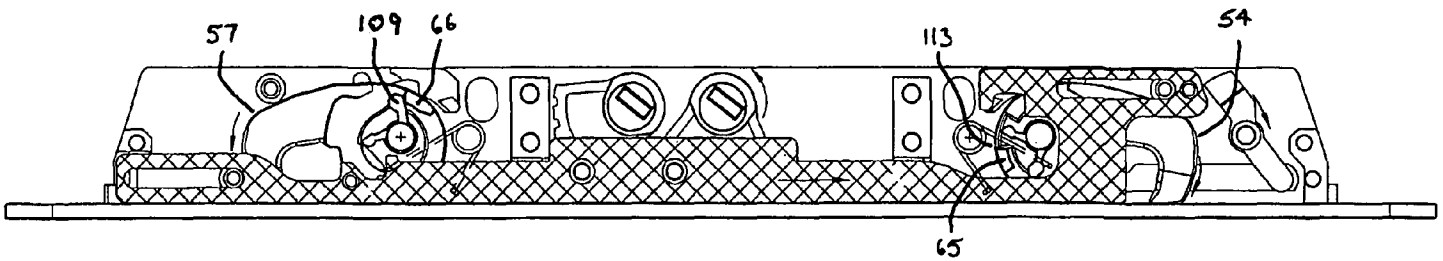

A synchronizing. link 80 may be in a form of generally elongated rectangular plate that may move vertically along an inner side of plate 2 of the housing. A synchronizing link may be positioned in overlaying relation to the rear wall 4 of the plate 2 and may extend from a lower hook 57 to an upper hook 54 in parallel relation to the plates 2 and 14 of the housing. The synchronizing link 80 may have a protrusion 92 on its lower Portion that may activate a lower hook 57 and the other protrusion 93 on its upper portion that may activate an upper hook 54 through a rocker arm 94 and a pushrod 95. The synchronizing link 80 may have cuts of such shape that the surfaces formed by those cuts may interact with both protrusions made in the upper and lower eccentric cams. It will be understood that the positioning of such protrusions 108 and 110 on the eccentric cam 76, and protrusions 107 and 109 on eccentric cam 77 are such that the synchronizing link 80 edges 115, 117, 116, and 118 moving vertically may respectively engage such cam protrusions causing turning movement (see FIGS. 17, 17A, and 17B).

With the hook in the locked position (FIG. 17), movement of synchronizing plate 80 causes edge 115 of the plate to contact protrusion 108 of cam 76, and edge 116 of the plate to contact protrusion 107 on cam 77. This contact causes both cams to rotate relative to the hooks, and causes the hooks to translate outward from the housing and disengage from the keeper. Rotation of the cams and translation of the hooks is continuous maintained as edge 117 of the plate 80 contacts protrusion 110 of cam 76, and edge 118 of the plate contacts protrusion 107 of cam 77. Translation of hooks 54 and 57 will occur until edge 113 of cam 76 strikes protrusion 65 of hook 54, and edge 112 of cam 77 strikes protrusion 68 of hook 57, at which point the hook's motion converts from translation out of the housing, to rotation about the cam mounting pins 78 and 79. (see FIG. 17A).

It will be seen that the turning movement of the thumb turn-key may move rotatably central actuators 74 and 75. This rotation may cause the geared bar 81 to move in a vertical direction. Because a synchronized link 80 is firmly connected to a geared bar 81, the rotation of the thumb turn-key may cause the vertical movement of a synchronizing link 80 along the inner face of plate 2 of the housing of a latch. The synchronizing link 80 may engage both upper and lower hooks 54 and 57; it may engage the upper hook 54 through a rocker arm 94, a pushrod 95 and a protrusion 93 made at the tip of the upper portion of the synchronizing link 80, and the lower hook 57 through a protrusion 92 made on the inner surface of the lower portion of the synchronizing link 80. It will be seen that when a turn-key is rotated from unlatched toward latched position a synchronizing link 80 may move upwardly along walls of a housing of a latch. A protrusion 93 made on the tip of the upper portion of the synchronizing link may engage the suspended end of the rocker arm 94 pushing it upward. Rocker arm 94 may have cylindrical extensions from the pivot and may be sized to insertably receive paired aligned apertures 13 and 17 and the length of such extensions may be sufficient to allow forming heads on the portion protruding from wall 3 of plate 2 and wall 16 of plate 14. The opposite end of a rocker arm 94 is pivotally connected to the pushrod 95 which in turn is pivotally connected to the hub portion 60 of the upper hook 54. Because an upper hook 54 is rotatably positioned on the pivotal eccentric cam 76 and may rotate around it, the vertical movement of a pushrod 95 causes the hub portion 60 of an upper hook 54 to rotate around an upper eccentric cam 76. Such vertical movement of the synchronizing link 80 may be limited by separator 96 that may be passed through the elongated aperture 98 made in the upper portion of the synchronizing link 80. The upper hook 54 may revolve from unlatched position to upright latched position in perpendicular relation to the synchronizing link 80. At the point an upper hook 54 revolves approximately 90 degrees from unlatched position, the further movement of the synchronized link 80 and therefore the revolving movement of the upper hook 54 may be prevented when separator 96 is pressed against the edge of the elongated aperture 98 made in the upper portion of the synchronizing link 80. A separator 97, an elongated aperture 99 and their positioning in the lower portion of the synchronizing link 80 may be identical to these of an upper one. However, in the preferred embodiment shown in the figures, it can be seen that both hooks 54 and 57 are limited from further rotation by separators 96 and 88 upon reaching their unlatched positions.

Eccentric cams 76 and 77 may freely rotate because they are not affected by separators 96 and 97. There are two torsion springs where each correspondingly connects the cams 76 and 77 with the front wall 15 of the plate 14 in such manner that compressing force of the spring 104 is directed toward rear edges of both plates 2 and 14 when both hooks 54 and 57 reach upright latched position. It would be seen that in such embodiment, although both hooks 54 and 57 remains immovable, both eccentric cams 76 and 77 may rotate around their off-center pins 78 and 79. The springs 104 and 103 may force the cams 76 and 77 to rotate toward the direction where such compression force is minimal. In one embodiment, because of the displaced position of the center of rotation of such cams 76 and 77 relative to their geometrical centers, the rotation of the cams 76 and 77 may cause both hooks 54 and 57 to translate toward the rear edge of the plates 2 and 14 until hub 60 bumpers 58 and 62 of hook 54, and hub 61 bumpers 59 and 51 of hook 57 are pressed against stops 67 and protrusions 105 and 106. Protrusions 105 and 106 are formed on surface 4 of plate 2. Hooks 54 and 57 are then in a locked position, and are resistant to tampering via external attempts to manually rotate the hooks to the unlocked position.

It will be understood that when the turn-key is rotated from the latched to unlatched position, in one embodiment the synchronizing link 80 may engage both eccentric cams 76 and 77 through protrusions 107 and 108 positioned on such eccentric cams 76 and 77 to rotate backwardly from locked position. Because both hooks 54 and 57 remain immovable, the rotation of both cams 76 and 77 may cause hub portions 60 and 61 of the hooks 54 and 57 to move toward the front edge of the plates 2 and 14 in the direction perpendicular the axis of rotation of both cams 76 and 77 until hub portions 60 and 61 of both hooks 54 and 57 are disengaged with protrusions 105 and 106 made on the rear edge of both plates 2 and 14 and hooks 54 and 57 may rotate. Then the further movement of the synchronizing link 80 may cause the further rotation of both cams until the engagement between link 80 and protrusions 107 and 108 is terminated. At this point of rotation of both cams, the link 80 engages the second set of protrusions 109 and 110 made on the extending portion 111 and 112 correspondingly of the upper and lower cams 76 and 77. At this point, the extending portions of the eccentric cams 76 and 77 engage the protrusions 65 and 66 correspondingly of the hub portions 60 and 61 of the hooks 54 and 57. Thus vertical movement of the synchronized link 80 may cause the rotation of the upper and lower cams 76 and 77 along with both hooks in the direction toward the unlatched position of the upper and lower hooks.

Those skilled in the art will readily appreciate that many modifications of the exemplary embodiment are possible without materially departing from the novel teachings and advantages of this invention. Different types of the resistance providing elements may be used to supply resistance to the movement of the handle from a "folded" to an "opened" position. Alternative mechanisms may provide for the coupling of various parts of the handle, different types of the engagement between the sliding and the pivotal members, between the sliding member and the assembly body, between the pivotal member and the assembly body or between the assembly body and the handle body. Furthermore, alternative shapes and configuration may be used for the sliding member, the pivotal member, the assembly body or the knob. All such variations and modifications intended to be included within the scope if this invention as defined in the following claims.

Other modifications, substitutions, omissions and changes may be made in the design, size, materials used or proportions, operating conditions, arrangement or positioning of elements and members of the preferred embodiment without departing from the spirit of this invention as described in the following claims.

We claim:

1. A multipoint latch of the type appropriate for use in sliding doors, said latch having a housing which houses two retractable hooks that work in co-action with at least one keeper that is set in a door jamb, so as to allow for locking and unlocking of the sliding door, wherein said multipoint door latch comprises:

(a) a pair of hooks that are respectively mounted upon a pair of eccentric cams, and, by the motion of a turn-key, are driven to rotate from a retracted position inside the housing to a position where each hook is generally in line with a portion of said at least one keeper, but remain displaced therefrom, each cam being biased by a spring, said spring biasing having a direction being coordinated with the corresponding cam's rotational position, and wherein a spring force, exerted by the spring, causes rotation of each cam relative to each hook, and movement of said cams from a first to a second position, said cam rotation relative to said hooks resulting in translation of said hooks from said in-line position to engage the keeper in a locked position;

(b) a pair of actuators responsive to said turn-key motion and configured such that said actuators drive said hooks into the locked position, and alternatively drive the cams to return the hooks back to the retracted position, where the hooks and respective cams are interconnected through at least a portion of the motion from said locked position to said retracted position and a portion of the motion from said retracted position to said locked position; and said hooks and respective cams also rotating freely relative to one another during a portion of the motion from said locked position to said retracted position and a portion of the motion from said retracted position to said locked position.

2. The multipoint door latch according to claim 1 wherein said latch further comprises a synchronizing plate, said synchronizing plate interconnecting said actuators to said hooks/cams to thereby drive at least a portion of said hook/cam motion.

3. The multipoint door latch according to claim 2 wherein said synchronizing plate has a periphery with one or more irregularly shaped cutouts, said one or more irregularly shaped cutouts co-acting with said cams to drive said cams and return said hooks to said retracted position.

4. The multipoint door latch according to claim 3 wherein said synchronizing plate includes one or more protrusions, said one or more protrusions co-acting with said hooks to drive said hooks and cams, and rotate said hooks from said retracted position to said in-line position.

5. The multipoint door latch according to claim 4 wherein said spring biasing of said cams causes rotation of said cams relative to said hooks, said relative rotation causing translation of said hooks from said in-line position to said locked position.

6. The multipoint latch according to claim 5 wherein said synchronizing plate has a pair of elongated apertures that ride along spacers mounted to said housing to guide plate movement.

7. The multipoint latch according to claim 6 wherein said spacers are placed in travel-limiting positions that coincide with the ends of said apertures.

8. The multipoint latch according to claim 5 wherein said synchronizing plate acts through a rocker arm and a push rod to cause rotation of one or more hooks and its respective cam.

9. The multipoint door latch according to claim 5 wherein each actuator of said pair of actuators comprise a segment gear; and wherein said synchronizing plate further comprises teeth that mesh with said segment gear.

10. The multipoint latch according to claim 9 wherein said teeth are formed on a toothed bar, said toothed bar protruding from said synchronizing plate.

11. The multipoint door latch according to claim 10 wherein said segment gear of each of said actuators comprises a toothed pivot arm and a hub portion, said toothed pivot arm extending from said hub portion of each actuator.

12. The multipoint door latch according to claim 11 wherein said hub portion has a trunnion for journaling in suitable apertures in said housing of said latch.

13. The multipoint door latch according to claim 12 wherein said hub portion has a drive slot sized to drivingly receive a tail member of said turnkey.

14. The multipoint door latch according to claim 13 wherein rotation of said tail member causes rotation of said actuators around their respective axes.

15. The multipoint latch according to claim 14 wherein rotating movement of said actuators cause rotating movement of said toothed pivot arm, and said movement of said toothed pivot arm causes the synchronizing plate to move within said housing.

16. The multipoint latch according to claim 1 wherein said eccentric cams comprise generally cylindrically shaped surfaces to interact with said corresponding hooks, where the axis of said generally cylindrical shape is parallel to but offset from the axis of mounting pins on said cams.

17. The multipoint latch according to claim 16 wherein said eccentric cam is integrally configured with two or more protrusions, and wherein at least one protrusions co-acts with its corresponding hook at specific points of cam rotation; and at least one protrusions co-acts with said irregularly shaped cutouts of said periphery of said synchronizing plate.

18. The multipoint latch according to claim 17 wherein each hook is comprised of a hook portion that originates from a hub having an aperture sized to mount upon said generally cylindrical surface of said eccentric cam.

19. The multipoint latch according to claim 18 wherein said hub portion has one or more protrusions which co-act with each corresponding cam.

20. The multipoint latch according to claim 1 wherein said springs comprise torsion springs.

21. The multipoint door latch according to claim 1 wherein said hooks rotate through approximately 90 degrees from said retracted position before reaching said in-line position.

22. The multipoint door latch according to claim 1 wherein said hooks are positioned such that outward rotation from a cover plate on said housing results in said hooks facing each other in said in-line position.

23. The multipoint door latch according to claim 1 wherein said hooks are positioned such that outward rotation from a cover plate on said housing results in said hooks facing away from each other when in said in-line position.

24. The multipoint door latch according to claim 1 in which said hooks are integrally configured with bumpers, said bumpers being sized and located to coordinate with hook rotation and translation so as to cause hook travel to be limited by said bumpers contacting stops on said housing.

25. A multipoint latch for use in locking and unlocking of a sliding door, said multipoint door latch comprising:

(a) a housing;

(b) a first hook and a second hook, said first and second hooks being adapted for selective travel between an unlocked position, wherein said hooks are retracted to be within said housing, and a locked position; said selective travel comprising hook rotation for at least a portion of said travel and hook translation for at least a portion of said travel; said first and second hooks being rotatably mounted upon respective first and second cams, each of said respective cams being pivotally mounted in said housing, said rotatable mounting of each of said hooks upon said respective cams being eccentric to said pivotal mounting of its respective cam;

(c) a first spring and a second spring, said first spring biasing said first cam relative to said housing and said second spring biasing said second cam relative to said housing, each of said springs biasing said respective cams in a direction relative to said housing, said biasing direction being coordinated with respective cam positioning;

(d) a first actuator and a second actuator, said actuators being responsive to the motion of a turn-key to thereby drive said first and second hooks and cause said hooks to rotate out from said retracted position, and wherein a protrusion on each of said hooks engages a corresponding protrusion on said respective cams permitting said rotation of said first and second hooks to cause corresponding rotation of said respective cams, each of said hooks rotating to a position where at least a portion of each of said hooks extends outside of said housing to be in line with a keeper but remaining displaced therefrom; said springs biasing said respective cams to counter said rotation and thereby bias said hooks, through said engagement of said hook protrusion with said cam protrusion, toward said retracted position, said biasing to counter said rotation continuing until said first and second hooks have rotated at least part way to said in-line position; and (e) wherein upon reaching said position being part way to said in-line position, said springs each then bias said respective cams to rotate, said cam biasing then being without corresponding biasing of said respective hooks; and (f) wherein upon reaching said in-line position, said actuators cease driving said hooks to rotate, and said spring biased rotation of said cams relative to said respective hooks causes translation of said respective hooks into said locked position wherein said respective hooks engage the keeper.

26. The multipoint door latch according to claim 25 wherein said one or more actuators, in response to reverse turn-key motion, overcomes said rotational spring biasing of said respective cams to drive said cams to rotate in an opposite direction so as cause reverse translation of said respective hooks from said engaged position to said in-line position; and wherein upon reaching said in-line position, said one or more springs bias said respective cams to rotate in an opposite direction, and wherein continued counter-rotation of said cams then causes said respective hooks to rotate in an opposite direction and travel from said in-line position to said retracted position.

27. A latch comprising:

a housing;

a first cam and a second cam, each of said cams being pivotally mounted in said housing to pivot respectively about a first axis and a second axis;

a first hook and a second hook, said first and second hooks being adapted for travel between an unlocked position and a locked position; said unlocked position being a position where said hooks are retracted into said housing, and said locked position being a position where at least a portion of each of said hooks extend outside of said housing and engage a keeper; said first and second hooks being rotatably mounted upon said first and second cams, respectively, said rotatable mounting of said hooks each comprising a rotation axis being parallel to, but displaced from, said pivotal axis of its respective cam;

a first spring and a second spring, said first spring biasing said first cam relative to said housing and said second spring biasing said second cam relative to said housing, each of said springs biasing said respective cams to rotate in a direction relative to said housing, with said direction being dependent upon rotational positioning of said respective cams;

a first actuator and a second actuator, said actuators being responsive to rotational motion of a turn-key to thereby drive said first and second hooks and cause said hooks to rotate outward from said retracted position, and wherein a first protrusion on each of said hooks engages a corresponding lateral extension on said respective cams to permit said rotation of said first and second hooks to cause corresponding rotation of said respective cams, each of said hooks rotating outward to a position where at least a portion of each of said hooks is in line with a keeper but remains displaced therefrom; said springs causing counter-rotational biasing of said respective cams, and thereby biasing said hooks, through said engagement of said hook protrusion with said cam extension, toward said retracted position; said counter-rotational biasing continuing until said first and second hooks have rotated at least part way to said in -line position; and wherein upon reaching said position being part way to said in-line position, said first and second springs each then cause rotational biasing of said respective cams, said rotational cam biasing being without corresponding biasing of said respective hooks; and wherein upon reaching said in-line position, said actuators stop driving said hooks to rotate, and said spring biased rotation of said cams relative to said respective hooks causes translation of said respective hooks into said locked position.

28. The latch according to claim 27, wherein said latch further comprises a synchronizing plate, said synchronizing plate interconnecting said actuators to said hooks to thereby drive said hook rotation.

29. The latch according to claim 28, wherein said synchronizing plate comprises a first protrusion, said first protrusion co-acting with said first hook to drive said rotation of said first hook; and wherein said synchronizing plate further comprises a second protrusion, said second protrusion co-acting with said second hook to drive said rotation of said second hook.

30. The latch according to claim 29, wherein said latch further comprises a rocker arm pivotally mounted in said housing, with one end of said rocker arm connected to said second hook by a pushrod; and wherein said second protrusion of said synchronizing plate driving said rotation of said second hook is by said second protrusion driving a second end of said rocker arm to thereby cause said second hook to rotate out from said housing.

31. The latch according to claim 30, wherein each of said actuators comprises a segment gear, with a hub of said segment gear being pivotally mounted in said housing; and wherein said synchronizing plate further comprises a plurality of teeth that mesh with teeth of said segment gear of each of said actuators; and wherein said rotational motion of said turn-key causes rotation of said segment gears, said segment gears rotating thereby causing translation of said synchronizing plate within said housing to drive said hooks.

32. The latch according to claim 31, wherein said synchronizing plate further comprises a pair of elongated apertures, each of said elongated apertures riding along one or more spacers mounted to said housing to guide said translation of said synchronizing plate; and wherein at least one or said one or more spacers is placed in a travel -limiting position that coincides with an end of said elongated aperture, said travel-limiting of said synchronizing plate serving to accomplish said hook rotation stopping at said in-line position.

33. The latch according to claim 32, wherein said housing comprises a cover plate and one or more walls, said one or more walls extending from said cover plate.

34. The latch according to claim 33, wherein said first and second springs each comprise a torsion spring having one end fixed to said housing and a second end fixed to a respective cam.

35. The latch according to claim 34, wherein said hooks rotate approximately 90 degrees from said retracted position before reaching said in-line position; and wherein said hooks are positioned such that outward rotation through an opening in said housing results in said hooks facing each other in said in-line position.

36. The latch according to claim 35, wherein each of said first and second hooks is comprised of a hook portion extending from a hub portion, said hub portion having an aperture to permit said rotational mounting upon said respective cam.

37. The latch according to claim 36, wherein each of said hooks further comprise one or more bumpers, said one or more bumpers engage with one or more stops on said housing to inhibit hook rotation when said hooks are translated into said locked position; and wherein said translation of said hooks into said locked position comprises translation of a portion of each of said hooks inward into said housing to draw said hook portion of each hook toward said keeper for engagement therebetween.

38. The latch according to claim 37, wherein counter-rotational motion of said turn-key causes said actuators to drive said synchronizing plate in reverse translation to thereby overcome said rotational spring biasing of said respective cams and cause said cams to counter-rotate, said counter-rotation of said cams causing reverse translation of said respective hooks from said engaged position to said in-line position; and wherein upon reaching said in-line position, said one or more bumpers of said hooks are disengaged from said one or more housing stops; and said lateral extension of each of said cams engages a second protrusion on each of said hooks so that continued counter-rotation of said cams by said synchronizing plate causes corresponding counter-rotation of said hooks from said in-line position toward said retracted position; and wherein when said cams cause said hooks to counter-rotate at least part way to said retracted position, said one or more springs then bias said respective cams to counter-rotate and cause said cams to drive said respective hooks into said retracted position.

39. The multipoint door latch according to claim 38 wherein said synchronizing plate comprises a periphery with two or more irregularly shaped cutouts, said two or more irregularly shaped cutouts being capable of co-acting with one or more protrusions on each of said first and second cams to cause said cams to counter-rotate during said reverse translation of said synchronizing plate.

40. The latch according to claim 39 wherein said first and second protrusions on each of said hooks comprise first and a second lateral protrusions from said hub of each of said hook; and wherein said lateral extension of each of said cams is received between said first and second lateral protrusions of said hook hub, to thereby permit said rotation of said hooks to result in said rotation of said cams for at least a portion of hook rotation, and to thereby permit said counter-rotation of said cam to result in said counter-rotation of said hooks for at least a portion of said cam counter-rotation.

* * * * *